United States Patent [19]

Eeles et al.

[11] 4,184,876

[45] Jan. 22, 1980

[54] COLOR PHOTOGRAPHIC MATERIALS HAVING INCREASED SPEED

[75] Inventors: Alan G. Eeles; Alan D. O'Neill, both of Chesham, England

[73] Assignee: Eastman Kodak Company, Rochester, N.Y.

[21] Appl. No.: 758,251

[22] Filed: Jan. 10, 1977

Related U.S. Application Data

[63] Continuation-in-part of Ser. No. 594,840, Jul. 8, 1975, abandoned.

[30] Foreign Application Priority Data

Jul. 9, 1974 [GB] United Kingdom ..... 30424/74

[51] Int. Cl.[2] ..... G03C 3/00; G03C 1/76; G03C 7/16

[52] U.S. Cl. ..... 430/505; 430/506

[58] Field of Search ..... 96/74, 68, 16, 22

[56] References Cited

U.S. PATENT DOCUMENTS

| | | | |
|---|---|---|---|
| 3,035,913 | 5/1962 | Hellmig | 96/74 |
| 3,227,554 | 1/1966 | Barr et al. | 96/74 |
| 3,620,747 | 11/1971 | Marchant et al. | 96/74 |
| 3,658,536 | 4/1972 | Wolf | 96/74 |
| 3,663,228 | 5/1972 | Wyckoff | 96/68 |
| 3,726,681 | 4/1973 | Pankow et al. | 96/74 |
| 3,849,138 | 11/1974 | Wyckoff | 96/74 |
| 3,930,813 | 1/1976 | Shiba et al. | 96/74 |
| 3,930,863 | 1/1976 | Shiba et al. | 96/74 |

FOREIGN PATENT DOCUMENTS

| | | | |
|---|---|---|---|
| 818687 | 8/1959 | United Kingdom | 96/74 |
| 923045 | 4/1963 | United Kingdom | 96/74 |
| 1021564 | 3/1966 | United Kingdom | 96/74 |
| 1461499 | 1/1977 | United Kingdom | 96/74 |
| 1461500 | 1/1977 | United Kingdom | 96/74 |

OTHER PUBLICATIONS

Focal Encyclopedia of Photography ©1969, McGraw-Hill, N.Y., N.Y., p. 1689.

Zelikman and Levi, "Making and Coating Photographic Emulsions," Focal Press, 1964, pp. 233–241.

Birr, Stabilization of Photographic AgX Emulsions ©1974, Focal Press, N.Y., N.Y., pp. 116, 117.

*Primary Examiner*—J. Travis Brown

*Assistant Examiner*—Louis Falasco

*Attorney, Agent, or Firm*—Joshua G. Levitt

[57] ABSTRACT

Color photographic materials are disclosed having red-, green- and blue-sensitive silver halide emulsion layer units, which units contain faster and slower emulsion layers for each color sensitivity. In such materials it has been found that increased speed can be obtained by manufacturing the material so that, upon imagewise exposure, light strikes the relatively faster green- and red-sensitive layers before passing to the slower green- and red-sensitive layers, but after penetrating the blue-sensitive layer(s).

21 Claims, 5 Drawing Figures

GREEN DENSITY
RED DENSITY
REL LOG SPEED
1.2
1.0
.8
.6
.4
.2
SPEEDS AT 0.6 ABOVE FOG
540
550
560
570
580
590
600
610
620
630
640
λ (nm)

GREEN DENSITY
RED DENSITY
REL LOG SPEED
1.2
1.0
.8
.6
.4
.2
SPEEDS AT 0.6 ABOVE FOG
540
550
560
570
580
590
600
610
620
630
640
λ (nm)

COLOR PHOTOGRAPHIC MATERIALS HAVING INCREASED SPEED

The invention relates to photographic silver halide multilayer color materials.

Photographic color materials are known which, instead of containing single red-, green- and blue-sensitive silver halide emulsion layers, contain these layers in pairs so that there is a faster and slower emulsion layer for each color sensitivity.

The present invention provides materials having a higher speed by altering the known layer positions.

It has been known heretofore that certain advantages could be obtained by coating multilayer color material in what has been termed "composite" layers or units, each of which units is made up of more than one discrete layer sensitized to the same region of the visible spectrum. In British Pat. No. 818,687, it was disclosed that by coating a relatively faster cyan-forming, red light-sensitized silver halide emulsion, for example, over a relatively slower emulsion having otherwise similar characteristics, not only increased speed, but also, increased exposure latitude was obtained. Similar benefits were obtained, according to this British disclosure, when this technique was applied to all three of the color composite layers or units.

Figure 1:
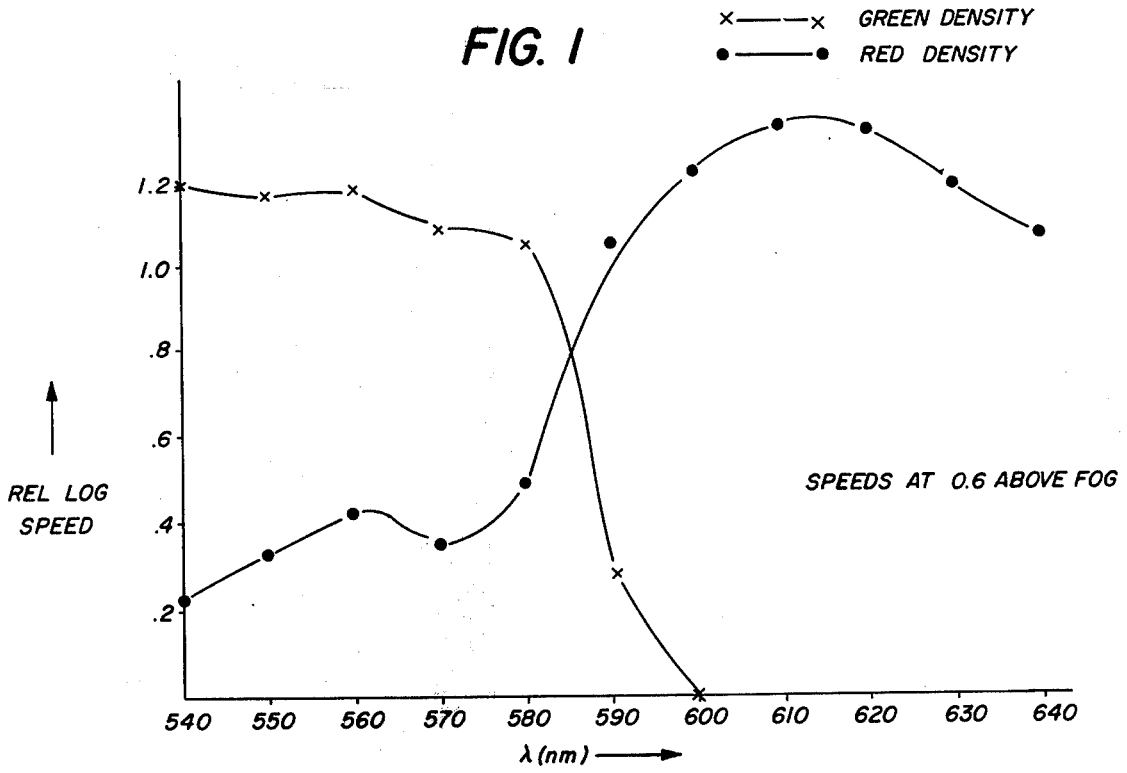

In U.S. Pat. Nos. 3,663,228 and 3,849,138 are disclosed many embodiments of an invention designed to result in elements having extremely increased exposure latitude, as compared with typical three-layer color film elements. In FIG. 1 C of that patent, the patentee illustrates a combination of (a) relatively faster blue-, green-, and red-sensitized layers farther from the support than (b) relatively slower correspondingly sensitized emulsion layers. The respective units of relatively faster and relatively slower emulsion layers are separated by a neutral density filter.

According to the present invention there is provided a photographic silver halide multilayer color material having a support bearing at least one blue-sensitive silver halide emulsion layer, at least two green-sensitive silver halide emulsion layers having different speeds and at least two red-sensitive silver halide emulsion layers having different speeds, wherein the positions of the layers are such that, in use, after penetrating the blue-sensitive layer(s), the exposing light strikes the faster green- and red-sensitive emulsion layers before passing to the slower green- and red-sensitive layers.

The preferred photographic materials contain an appropriate dye-forming coupler incorporated in each silver halide emulsion layer or in a layer adjacent thereto. However, color materials containing no couplers and which can be processed with developer solutions containing couplers are included within the scope of this invention. The preferred materials are negative-acting color materials, although direct positive color materials may also be constructed according to the present invention. Using an appropriately chosen format and dye transfer and/or dye releasing materials, the present invention can also include diffusion transfer elements, such as those described in U.S. Pat. Nos. 3,415,644; 3,415,645 and 3,415,646 and in Canadian Pat. Nos. 928,559 and 928,560.

Dye-forming couplers, sensitizing dyes, supports and additives of varying type which may be employed in connection with the present materials are known in the art, for example, as described in Product Licensing Index, Vol. 92, December 1971, pages 107–110. Combinations of sensitizing dyes which may be employed which relate to so-called theoretical sensitization are described in British patent specification No. 1,252,066.

A preferred material according to the present invention contains a support and silver halide emulsion layers in the following relative positions:

| | |
|---|---|
| blue-sensitive layer(s) | |
| blue-absorbing filter layer | |
| faster green-sensitive layer | faster emulsion unit |
| faster-red sensitive layer | |
| slower green-sensitive layer | slower emulsion unit |
| slower red-sensitive layer | |
| support. | |

A mixture having this relative layer arrangement is intended for exposure through the face of the element opposite the support. It will be appreciated that in a material intended for exposure through the support, the order of exposure referred to on page 3, lines 7–11 will be maintained by inverting the relative positions of the layers on the support, so that they will have the following relative positions:

| | |
|---|---|
| slower red-sensitive layer | slower emulsion unit |
| slower green-sensitive layer | |
| faster red-sensitive layer | faster emulsion unit |
| faster green-sensitive layer | |
| blue-absorbing filter layer | |
| blue-sensitive layer(s) | |
| support. | |

If desired, the "slower emulsion unit" illustrated above can be comprised of two or three or more sub-units, each sub-unit having red- and green-sensitized layers, with each sub-unit being progressively slower so that, upon exposure, the light travels through the slowest sub-unit last. Alternatively, each of the layers in the faster emulsion unit or the slower emulsion unit can be comprised of two or more layers of the same spectral sensitivity but of different speeds, as described in British Pat. Nos. 818,687 and 923,045.

The blue-sensitive layer can be a single emulsion layer or it can be a blue-sensitive unit containing two, three or more blue-sensitive emulsion layers. The blue-sensitive unit can contain relatively faster and relatively slower blue-sensitive layers. If faster and slower blue-sensitive layers are utilized, they can be arranged in varying relative positions. If they are arranged so that light travels through the faster blue-sensitive layer before striking the slower blue-sensitive layer, improved speed and exposure latitude will be obtained in the blue-sensitive unit. If they are arranged so that light travels through the slower blue-sensitive layer before striking the faster blue-sensitive layer and then passing to the faster green-sensitive layer, advantageous interimage effects will be obtained between the faster blue-sensitive layer and the faster green-sensitive layer.

The difference in speed between the relatively faster and slower layers, as referred to herein, is preferably such that extended latitude in the photographic element is achieved without an appreciable distortion of the shape of the sensitometric curve. Generally, this difference in speed should be within the range of from about 0.2 to about 1 log E (E being exposure) and preferably will be about 0.5 log E, as between each relatively faster and relatively slower layer of a given color-sensitized emulsion type.

While it will usually be desirable to employ colorless interlayers between adjacent red- and green-sensitive units so as to reduce unwanted migration of oxidized developer during processing, the desirability of such interlayers can be determined readily by experiment in any specific situation and, if desired, the interlayer(s) can be omitted.

The technology relating to the use of color-forming couplers in conjunction with photographic emulsions is well known and need not be detailed here, except to emphasize that in the preferred practice of this invention, incorporated color-forming couplers are present in each of the photosensitive layers of the present photographic elements. It is also preferred that relatively less coupler, on a silver equivalent basis, be present in the relatively faster layer(s), respectively, than in the relatively slower layer(s) of the magenta-forming and/or the cyan-forming emulsions. Examples of the types of color-forming couplers that can be used in the practice of this invention can be found in the references described in Part XXII of the aforementioned article in Product Licensing Index, Vol. 92, December 1971, page 110. Methods for "incorporating" couplers during the manufacture of our photographic elements are also described in some of the reference designated in this same Product Licensing Index article.

According to a preferred embodiment of the present invention there is provided a photographic material in which the slower green-sensitive and/or slower red-sensitive emulsion layers contain respectively a DIR (Development Inhibitor Releasing) coupler; preferably a magenta and/or cyan dye-forming DIR coupler, incorporated therein or in an adjacent layer. Examples of DIR couplers that can be used in the practice of the present invention are described in detail in U.S. Pat. No. 3,227,554, for example. Thus, DIR couplers are associated with a slower green-sensitive layer and, optionally but preferably, also with a slower red-sensitive layer in the photographic elements of this invention. The DIR couplers are preferably employed in amounts of up to 1.7 mg/dm$^2$ in or adjacent each of the said emulsion layers, preferably in amounts of 0.2–0.9 mg/dm$^2$. These DIR couplers exhibit interlayer interimage effects which, in particular, reduce unwanted development in the red-sensitive layer as a function of green exposure.

Conventional levels of silver halide can be employed in the emulsion layers of the present invention.

The accompanying FIGS. 1 through 5 illustrate the red and green spectral sensitivities of several photographic elements of this invention. The significance of each Figure is described at the appropriate places in the examples herein.

In order to obtain improved granularity, but usually at the expense of speed, the faster green-sensitive and/or faster red-sensitive emulsion layers can contain, respectively, a magenta or cyan dye-forming DIR coupler incorporated therein or in a layer adjacent to the respective faster green- or red-sensitive layer. In this case the DIR couplers are preferably employed in amounts of up to 0.33 mg/dm$^2$ in, or adjacent to, each of the said emulsion layers, preferably in amounts of 0.1–0.2 mg/dm$^2$. Also, the faster red- and green-sensitive layers can be relatively "starved" with respect to their color coupler contents in order to improve the granularity of these layers. (See Br. 923,045). That is, in one preferred aspect of this invention, relatively smaller amounts of coupler are used in the relatively faster green- and/or red-sensitive layer(s) of the present photographic elements, such that, upon exposure and development, these relatively faster layer(s) produce a colored image which is less dense than that produced in the relatively slower layer(s) of the same color unit.

In known negative-working color films, which are intended to produce negative images, it is common practice to use colored dye-forming couplers which automatically form a color correcting mask on exposure and processing. Such couplers are described in U.S. Pat. No. 2,801,171, and can be used in the practice of this invention. In particular, a yellow colored magenta dye-forming coupler may be used in the green-sensitive emulsion layers and a magenta colored cyan-dye-forming coupler can be used in the red-sensitive layers. In negative-working color films constructed according to the present invention it is preferred that the faster red-sensitive emulsion layer be free of magenta colored cyan dye-forming coupler in order to obtain optimum photographic speed in that layer and the adjacent fast green-sensitive layer.

It should be noted that the structure of the present materials is ideal for exploiting interimage effects between each pair of green and red-sensitive emulsion layers. The incorporation of DIR couplers therein has been mentioned above. It is also possible to incorporate a DIR coupler in an interlayer between the green- and red-sensitive emulsion layers to produce desirable interimage effects. Such a DIR coupler is preferably non-color-forming and colorless.

If it is desired to make a direct comparison between color materials according to the present invention and color materials having a conventional layer structure, it will be found necessary to adjust the silver and coupler laydowns to achieve the same contrast. When this is done, it is found that the materials according to the present invention have a higher speed, but the same granularity. Alternatively, of course, it could be arranged for the present materials to have the same speed with lower granularity.

The invention is illustrated in the following examples. The words "Kodak" and "Flexicolor" are trademarks. Examples of the couplers that can be employed are identified after the Examples. Some results are given in FIGS. 1–5 of the accompanying drawings. In order to illustrate the noncriticality of the present invention with respect to the selection of particular color-forming couplers, the designation of couplers in the various photographic elements described in the following examples is made with reference to "groups" of typical, useful couplers, any of which can be used in the example with substantially similar comparative results with regard to speed, granularity and clarity of the prepared photographic elements. In commercial practice, some coupler combinations may be preferred over others for various reasons, including hue, relative coupler reactivity and the like.

EXAMPLE 1

A prior art "control" multilayer negative color film (1) was made having the following structure:

| | | | |
|---|---|---|---|
| Layer 8 | Protective Gelatin Overcoat | | |
| Layer 7 | Blue-sensitive, yellow dye-forming layer | | |
| Layer 6 | Yellow colloidal silver filter layer | | |
| Layer 5 | Fast green-sensitive, | 14.0 mg/dm$^2$ | fast, green-sensitive AgBrI |
| | magenta dye-forming | 3.24 mg/dm$^2$ | magenta forming coupler-Group 4 |
| | silver halide emulsion | 0.38 mg/dm$^2$ | yellow colored, magenta dye-forming coupler-Group 5 |
| | layer | 16.2 mg/dm$^2$ | gelatin |
| Layer 4 | Slow green-sensitive, | 8.1 mg/dm$^2$ | medium speed, green-sensitive AgBrI |
| | magenta dye-forming | 8.1 mg/dm$^2$ | slow, green-sensitive AgBrI |
| | silver halide emulsion | 7 mg/dm$^2$ | magenta forming coupler-Group 4 |
| | layer | 1.1 mg/dm$^2$ | yellow colored, magenta-forming coupler-Group 5 |
| | | 1.1 mg/dm$^2$ | magenta forming DIR coupler-Group 6 |
| | | 17.28 mg/dm$^2$ | gelatin |
| Layer 3 | Interlayer containing 8.91 mg/dm$^2$ gelatin | | |
| Layer 2 | Fast red-sensitive | 11.1 mg/dm$^2$ | fast red-sensitive AgBrI |
| | cyan dye-forming | 3.8 mg/dm$^2$ | cyan dye-forming coupler-Group 1 |
| | silver halide | 0.22 mg/dm$^2$ | magenta colored, cyan dye-forming coupler-Group 2 |
| | emulsion layer | 16.2 mg/dm$^2$ | gelatin |
| Layer 1 | Slow red-sensitive | 9.7 mg/dm$^2$ | medium speed, red-sensitive AgBrI |
| | cyan dye-forming | 12.4 mg/dm$^2$ | slow red-sensitive AgBrI |
| | silver halide | 8.6 mg/dm$^2$ | cyan dye-forming coupler-Group 1 |
| | emulsion layer | 0.65 mg/dm$^2$ | magenta colored, cyan dye-forming coupler-Group 2 |
| | | 1.19 mg/dm$^2$ | cyan dye-forming DIR coupler-Group 2 |
| | | 19.4 mg/dm$^2$ | gelatin |
| | Film Support | | |

A multilayer negative color film (2) according to the invention was made having the following structure:

| | |
|---|---|
| Layer 10 | Protective Gel Overcoat (layer 8 of (1)) |
| Layer 9 | Blue-sensitive, yellow dye-forming layer (layer 7 of (1)) |
| Layer 8 | Yellow filter layer (layer 6 of (1)) |
| Layer 7 | Fast, green-sensitive, magenta dye-forming layer (layer 5 of (1)) |
| Layer 6 | Interlayer containing 8.91 mg/ft$^2$ gelatin |
| Layer 5 | Fast, red-sensitive, cyan dye-forming layer (layer 2 of (1)) |
| Layer 4 | Interlayer containing 8.91 mg/dm$^2$ gelatin |
| Layer 3 | Slow, green-sensitive, magenta dye-forming layer (layer 4 of (1)) |
| Layer 2 | Interlayer containing 8.91 mg/dm$^2$ gelatin |
| Layer 1 | Slow, red-sensitive, cyan dye-forming layer (layer 1 of (1)) |
| | Film Support |

Both films were exposed on a sensitometer through a step tablet of 0.2 density increment and processed using the Kodak Flexicolor process which is described in the British Journal of Photography, July 12, 1974 issue, pages 597–598. The relative log speed of red and green at 0.2 above minimum density was assessed and the results tabulated below.

Table 1

| Film | Relative Log Speed Red | Relative Log Speed Green |
|---|---|---|
| 1 - Control | 2.80 | 3.03 |
| 2 - Invention | 3.20 | 2.93 |

While, in this instance, "green" speed was not improved, the large increase in "red" speed was very significant.

EXAMPLE 2

Another prior art "control" multilayer color film (3) was made having the following structure:

| | | |
|---|---|---|
| | Protective Gelatin Overcoat | |
| | Blue-sensitive, yellow dye forming layer(s) | |
| | Yellow filter layer | |
| Fast Green-sensitive | 16.2 mg/dm$^2$ | fast, green-sensitive AgBrI |
| magenta dye-forming | 1.3 mg/dm$^2$ | magenta dye-forming coupler-Group 4 |
| layer | 0.63 mg/dm$^2$ | yellow colored, magenta-forming coupler-Group 7 |

-continued

| | | |
|---|---|---|
| | Protective Gelatin Overcoat | |
| | Blue-sensitive, yellow dye forming layer(s) | |
| | Yellow filter layer | |
| | 21.6 mg/dm$^2$ | gelatin |
| Slow green-sensitive | 4.9 mg/dm$^2$ | medium speed, green-sensitive, AgBrI |
| magenta dye-forming | 9.2 mg/dm$^2$ | slow green-sensitive AgBrI |
| layer | 4.3 mg/dm$^2$ | magenta dye-forming coupler-Group 4 |
| | 2.1 mg/dm$^2$ | yellow colored, magenta dye-forming coupler-Group 7 |
| | 21.6 mg/dm$^2$ | gelatin |
| | Interlayer containing 8.91 mg/dm$^2$ gelatin | |
| Fast red-sensitive | 18.9 mg/dm$^2$ | fast red-sensitive AgBrI |
| | 1.6 mg/dm$^2$ | cyan dye-forming coupler-Group I |
| cyan dye-forming | | magenta colored, cyan dye- |
| | 0.18 mg/dm$^2$ | forming coupler-Group 2 |
| layer | 21.6 mg/dm$^2$ | gelatin |
| Slow red-sensitive | 8.6 mg/dm$^2$ | medium speed, red- |
| | 4.3 mg/dm$^2$ | sensitive AgBrI |
| cyan dye-forming | | slow red-sensitive AgBrI |
| | 4.3 mg/dm$^2$ | slower red-sensitive AgBrI |
| layer | 6.5 mg/dm$^2$ | cyan dye-forming coupler-Group 1 |
| | 0.7 mg/dm$^2$ | magenta colored, dye-forming coupler-Group 2 |
| | 21.6 mg/dm$^2$ | gelatin |
| | Film Support | |

A similar color film (4) was made according to the invention, having adjusted silver halide and coupler laydowns, having the following structure:

Another color film (5) according to the invention was made which differs from (4) mainly by the omission of the magenta colored cyan forming coupler from the fast red-sensitive layer. It has the following structure:

| | | |
|---|---|---|
| | Protective Gelatin Overcoat | |
| | Blue-sensitive, yellow dye-forming layer(s) | |
| | Yellow filter layer | |
| Fast Green-sensitive | 16.2 mg/dm$^2$ | fast, green-sensitive AgBrI |
| magenta dye-forming | 2.6 mg/dm$^2$ | magenta dye-forming coupler - Group 4 |
| | 1.25 mg/dm$^2$ | yellow colored, magenta dye-forming coupler - Group 7 |
| | 21.6 mg/dm$^2$ | gelatin |
| | Interlayer containing 8.91 mg/dm$^2$ gelatin | |
| Fast Red-sensitive | 21.6 mg/dm$^2$ | fast red-sensitive AgBrI |
| | 3.25 mg/dm$^2$ | cyan dye-forming coupler - Group 1 |
| cyan dye-forming | | magenta colored, cyan |
| | 0.36 mg/dm$^2$ | dye forming coupler - Group 2 |
| layer | 21.6 mg/dm$^2$ | gelatin |
| | Interlayer containing 8.91 mg/dm$^2$ gelatin | |
| Slow green-sensitive | 3.24 mg/dm$^2$ | fast green-sensitive AgBrI |
| magenta dye-forming | 7.6 mg/dm$^2$ | medium speed, green-sensitive AgBrI |
| layer | 8.6 mg/dm$^2$ | slow green-sensitive AgBrI |
| | 6.5 mg/dm$^2$ | magenta dye-forming coupler - Group 4 |
| | 1.1 mg/dm$^2$ | yellow colored, magenta dye-forming coupler - Group 5 |
| | 24.3 mg/dm$^2$ | gelatin |
| | Interlayer containing 8.91 mg/dm$^2$ gelatin | |
| Slow red-sensitive | 7.6 mg/dm$^2$ | medium speed, red-sensitive AgBrI |
| cyan dye-forming | 3.8 mg/dm$^2$ | slow red-sensitive AgBrI |
| | 4.3 mg/dm$^2$ | slower red-sensitive AgBrI |
| layer | 5.9 mg/dm$^2$ | cyan dye-forming coupler - Group 1 |
| | 0.66 mg/dm$^2$ | magenta colored cyan dye-forming coupler - Group 2 |
| | 21.6 mg/dm$^2$ | gelatin |
| | Film Support | |

| | | |
|---|---|---|
| | Protective Gelatin Overcoat | |
| | Blue-sensitive, yellow dye-forming layer(s) | |
| Yellow filter layer | | |
| Fast green-sensitive | 16.2 mg/dm$^2$ | fast, green-sensitive AgBrI |
| magenta dye-forming | 2.6 mg/dm$^2$ | magenta dye-forming coupler - Group 4 |
| layer | 1.25 mg/dm$^2$ | yellow colored, magenta dye-forming coupler - Group 7 |
| | 21.6 mg/dm$^2$ | gelatin |
| | Interlayer containing 8.91 mg/dm$^2$ gelatin | |
| Fast red-sensitive | 21.6 mg/dm$^2$ | fast red-sensitive AgBrI |
| | 4.9 mg/dm$^2$ | cyan dye-forming coupler-Group 1 |
| cyan dye-forming layer | 21.6 mg/dm$^2$ | gelatin |
| | Interlayer containing 8.91 mg/ft$^2$ gelatin | |
| Slow green-sensitive | 7.6 mg/dm$^2$ | medium speed, green-sensitive AgBrI |
| magenta dye-forming | 11.9 mg/dm$^2$ | slow green-sensitive AgBrI |
| | 6.5 mg/dm$^2$ | magenta dye-forming coupler - Group 4 |
| layer | 1.1 mg/dm$^2$ | yellow colored, magenta dye-forming coupler - Group 5 |
| | 24.3 mg/dm$^2$ | gelatin |
| | Interlayer containing 8.91 mg/dm$^2$ gelatin | |
| Slow red-sensitive cyan dye-forming layer | as Film 3 | |
| | Film Support | |

The films are exposed and processed as in Example 1 with the following results.

Table 2

| Film | Relative log Speeds (0.1 above minimum density) Red | Green |
|---|---|---|
| 3 - Control | 2.95 | 3.18 |
| 4 - Invention | 3.20 | 3.21 |

Table 2-continued

| Film | Relative log Speeds (0.1 above minimum density) Red | Green |
|---|---|---|
| 5 - Invention | 3.21 | 3.30 |

EXAMPLE 3

Two multilayer color films 6A and 6B were made having the following common structure:

| | | |
|---|---|---|
| | Blue-sensitive layer(s) | |
| Yellow Filter Layer | | |
| Fast green-sensitive | 16.2 mg/dm$^2$ | high speed AgBrI green-sensitized |
| magenta dye-forming | 3.24 mg/dm$^2$ | magenta dye-forming coupler - Group 4 |
| emulsion layer | 0.55 mg/dm$^2$ | yellow colored magenta dye-forming coupler - Group 5 |
| | Interlayer | |
| Fast red-sensitive | 21.6 mg/dm$^2$ | high speed AgBrI red-sensitized |
| cyan dye-forming emulsion layer | 4.9 mg/dm$^2$ | cyan dye-forming coupler - Group 1 |
| | Interlayer | |
| Slow green-sensitive | 8.6 mg/dm$^2$ | medium speed AgBrI green-sensitized |
| magenta dye-forming | 11.9 mg/dm$^2$ | lower speed AgBrI green-sensitized |
| emulsion layer | 6.5 mg/dm$^2$ | magenta dye-forming coupler - Group 4 |
| | 1.1 mg/dm$^2$ | yellow colored magenta dye-forming coupler - Group 5 |
| | Interlayer | |
| Slow red-sensitive | 8.6 mg/dm$^2$ | medium speed AgBrI red-sensitized |
| cyan dye-forming | 4.3 mg/dm$^2$ | lower speed AgBrI red-sensitized |
| emulsion layer | 6.5 mg/dm$^2$ | lower speed AgBrI red-sensitized |
| | 6.5 mg/dm$^2$ | cyan dye-forming coupler - Group 1 |
| | 0.72 mg/dm$^2$ | magenta colored cyan dye-forming coupler - Group 2 |

-continued

| Film Support |
|---|

Film 6A used sensitizing dyes in the red-sensitive yers which gave a peak at about 620 nm while Film 6B sed dyes giving a peak at about 610 nm.

Figure 2:
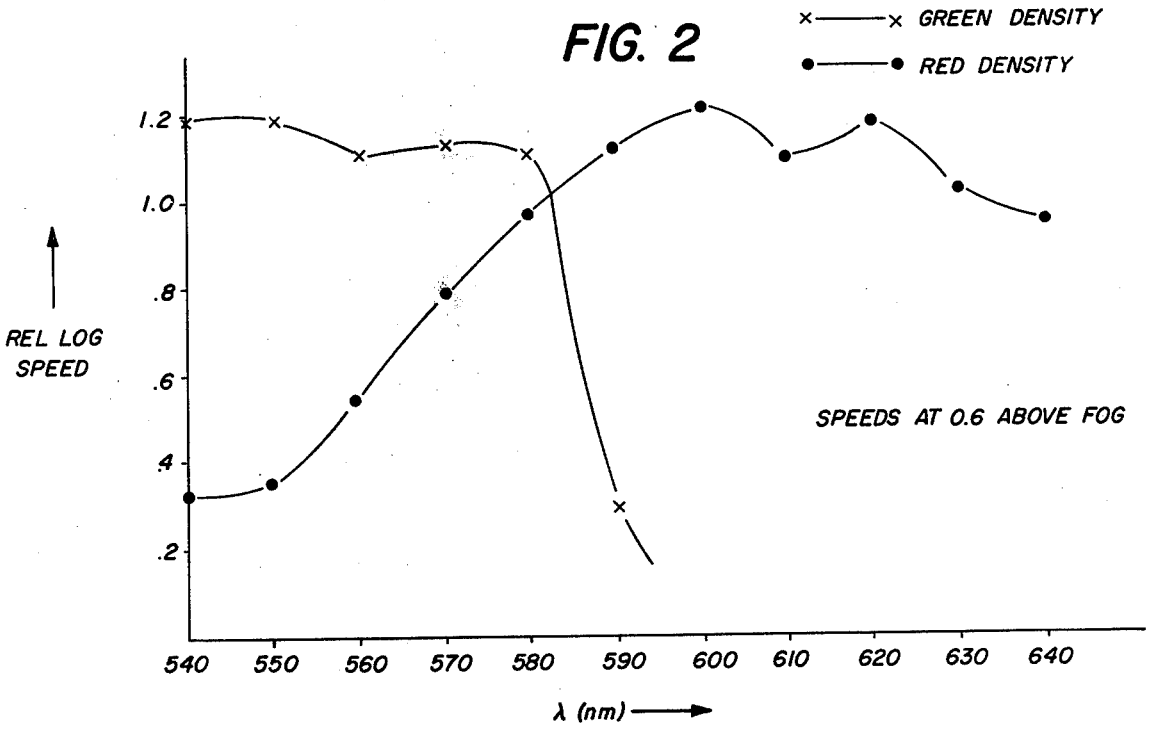

The spectral sensitivities of the two films are shown FIGS. 1 and 2.

EXAMPLE 4

Three multilayer color films 7A, 8A and 8B were ade based on the corresponding films 6A and 6B de-ribed in Example 3 except that the slow green-sensi-ve layer of 7A and the slow green- and red-sensitive yers of 8A and 8B contained DIR couplers.

Film 7A had the following slow green- and red-sensi-ve layer structure:

| | | |
|---|---|---|
| | Interlayer | |
| low green-sensitive | 10.3 mg/dm$^2$ | medium speed AgBrI green-sensitized |
| agenta dye-forming | 16.2 mg/dm$^2$ | lower speed AgBrI green-sensitized |
| nulsion layer | 8.5 mg/dm$^2$ | magneta dye-forming coupler-group 4 |
| | 1.5 mg/dm$^2$ | Yellow colored magneta dye-forming coupler - Group 5 |
| | 0.86 mg/dm$^2$ | DIR magenta dye-forming coupler - Group 8 |
| | Interlayer | |
| low red-sensitive | 8.6 mg/dm$^2$ | medium speed AgBrI red-sensitized |
| yan dye-forming | 5.3 mg/dm$^2$ | lower speed AgBrI red-sensitized |
| mulsion layer | 4.3 mg/dm$^2$ | lower speed AgBrI red-sensitized |
| | 6.5 mg/m$^2$ | cyan dye-forming coupler - Group 1 magenta colored, cyan |
| | 0.72 mg/dm$^2$ | dye-forming coupler - Group 2 |
| | Film Support | |

Films 8A and 8B had the following common struc-ure for their slow green- and red-sensitive layers.

| | | |
|---|---|---|
| | Interlayer | |
| low green-sensitive | 14.0mg/dm$^2$ | medium speed AgBrI green-sensitized |
| nagenta dye-forming | 19.4 mg/dm$^2$ | Lower speed AgBrI green-sensitized |
| mulsion layer | 8.5 mg/dm$^2$ | magenta dye-forming coupler - Group 4 |
| | 1.5 mg/dm$^2$ | yellow colored magenta dye-forming coupler - Group 5 |
| | 1.7 mg/dm$^2$ | DIR magenta dye-forming coupler - Group 8 |
| | Interlayer | |
| low red-sensitive | 13.0 mg/dm$^2$ | medium speed AgBrI red-sensitized |
| yan dye-forming | 8.6 mg/dm$^2$ | lower speed AgBrI red-sensitized |
| mulsion layer | 10.8 mg/dm$^2$ | lower speed AgBrI red-sensitized |
| | 8.6 mg/dm$^2$ | cyan coupler-Group 1 |
| | 0.96mg/dm$^2$ | magenta colored cyan dye-forming coupler-Group 2 |
| | 0.65 mg/dm$^2$ | DIR cyan dye-forming coupler-Group 3 |
| | Film Support | |

Figure 3:
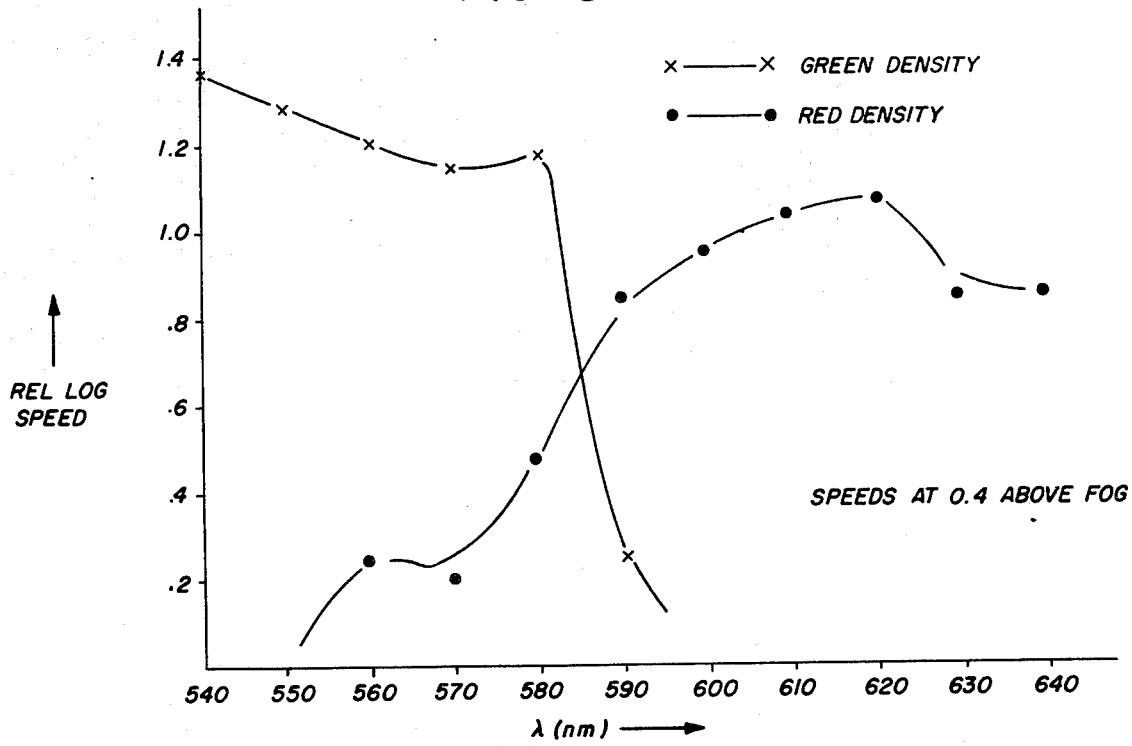
Figure 4:
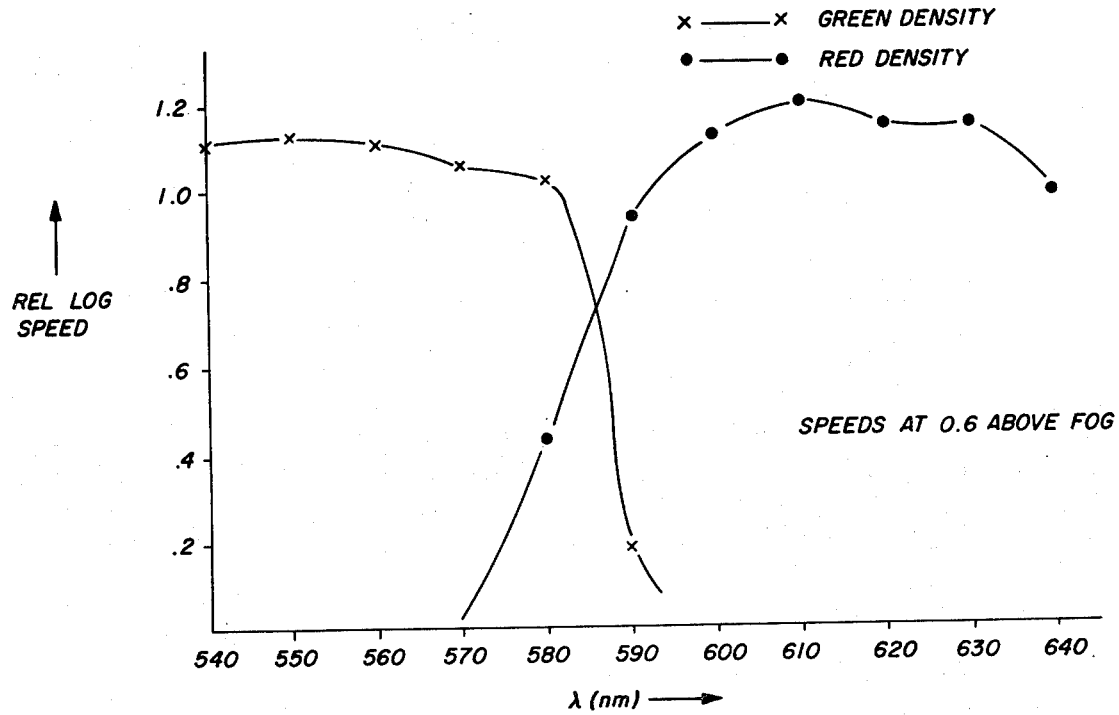
Figure 5:
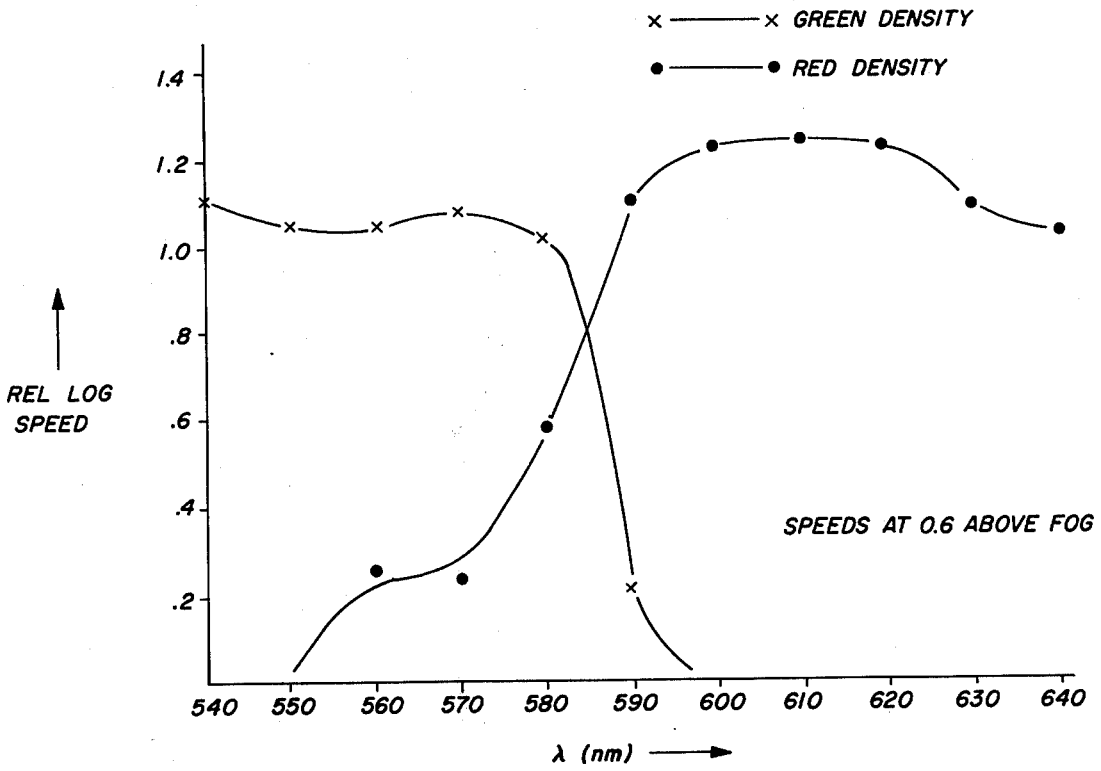

The spectral sensitivity curves for these films are given in FIGS. 3–5. It can be seen that the inclusion of the DIR couplers effectively corrects the unwanted green sensitivity of the red-sensitive layers. The granularity of these layers tends to show improvement when the DIR couplers are used.

Examples of couplers that can be used in the above Examples are set out below.

EXAMPLES OF COUPLERS USEFUL IN EXAMPLES I THROUGH IV

Coupler Group No. 1 - Cyan dye-forming coupler (see U.S. Pat. Nos. 2,474,293 and 2,895,826)

a. 1-Hydroxy-2-[Δ-(2,4-di-tert-amylphenoxy)-n-butyl]-naphthamide b. 1-Hydroxy-2-[β-(2,4-di-tert-amylphenoxy)ethyl]-naphthamide c. 5-[α-(2,4-di-tert-amylphenoxy)hexanamido]-2-heptafluorobutyramidophenol d. 1-Hydroxy-2-[β-(2,4-di-tert-amylphenoxy)-n-butyl]-naphthamide.

Coupler Group No. 2 - Cyan dye-forming colored coupler (See U.S. Pat. No. 3,476,563)

a. 1-Hydroxy-4-phenylazo-2-[4'-(p-tert-butylphenoxy)]-naphthamide
b. 1-Hydroxy-4-(4-[2-{8-acetamido-1-hydroxy-3,6-disulphonaphthyl}azo]phenoxy)-2-(α-[2,4-di-tert-amylphenoxy]butyl]-naphthamide.
c. 4-(2-Acetylphenylazo)-1-hydroxy-2-[Δ-(2,4-di-tert-amylphenoxy)-n-butyl]naphthamide
d. 1-Hydroxy-4-phenylazo-N-isoamyl-2-naphthanilide
e. 4-{7-[1-Acetamido-3,6-disulfonate-8-hydroxy]naphthylazo}phenoxy-1-hydroxy-2-[δ-(2,4-di-tert-amylphenoxy)-n-butyl]naphthamide Coupler Group No. 3 - Cyan dye-forming DIR coupler (See U.S. Pat. No. 3,227,554)

a. 1-Hydroxy-N-(2-n-tetradecyloxyphenyl)-4-(1-phenyl-5-tetrazolylthio)-2-naphthamide.
b. 1-Hydroxy-4-(5-phenyl-1,3,4-oxadiazolyl-2-thio)-N-[β-(3,5-dichlorosulfonylbenzamido)ethyl]-2-naphthamide
c. 1-Hydroxy-N-(2-n-tetradecyloxyphenyl)-4-(2-benzothiazolylthio)-2-naphthamide
d. 1-hydroxy-4-[1-(4-carbomethoxyphenyl)-5-tetrazolylthio]-N-[δ-(2,4-di-tert-amylphenoxy)butyl]-2-naphthamide
e. 1-Hydroxy-4-(1-phenyl-5-tetrazolylthio)-4'-(2,4-di-tert-amylphenoxy)-2-naphthanilide Coupler Group No. 4 - Magenta dye-forming coupler - (See U.S. Pat. Nos. 2,600,788 and 3,519,429)

a. 1-(2,4,6-Trichlorophenyl)-3-[β-(2,4-di-tert-amylphenoxypropionamido]-5-pyrazolone
b. 1-{4-[α-(3-t-butyl-4-hydroxyphenoxy)tetradecanamido]-2,6-dichlorophenyl}-3-(2,4-dichloroanilino)-5-pyrazolone
c. 1-(2,4,6-Trichlorophenyl)-3-[3-(α-(2,4-di-tert-amylphenoxy)acetamido)-benzamido]-5-pyrazolone
d. 1-{4-[α-(3-t-butyl-4-hydroxyphenoxy)hexanamido]-phenyl}-3-pentadecyl-4-carboxyphenoxy-5-pyrazolone
e. 1-(2,4,6-Trichlorophenyl)-3-{3-[α-(3-t-butyl-4-hydroxyphenoxy)tetradecanamido]benzamido}-4-phenyl-5-pyrazolone Coupler Group No. 5 - Magenta dye-forming color coupler (See U.S. Pat. No. 2,983,608)

a. 1-(2,4,6-Trichlorophenyl)-3-[α-(3-tert-butyl-4-hydroxylphenoxy)tetradecanamido-2-chloroanilino]-4-(1-naphthylazo)-5-pyrazolone
b. 1-(2,4,6-Trichlorophenyl)-3-{3-[α-(3-tert-butyl-4-hydroxyphenoxy)tetradecanamido]-benzamido}-4-phenylazo-5-pyrazolone
c. 4-(α-Naphthylazo)-1-(2,4,6-trichlorophenyl)-3-{5-[(3-tert-butyl-4-hydroxyphenoxy)tetradecaneamido]-2-chloroanilino}-5-pyrazolone
d. 4-(p-Methoxyphenylazo)-1-(2,4,6-trichlorophenyl)-3-[4-{α-(2,4-di-tert-amylphenoxy)butyramido}anilino]-5-pyrazolone
e. 1-[2,6-Dichloro-4-(α-{4-hydroxy-3-tert-butylphenoxy}tetradecaneamido)phenyl]-3-(2,4-dichloroanilino)-4-(4-methoxyphenylazo)-5-pyrazolone Coupler Group Nos. 6 and 8 - Magenta dye-forming DIR coupler (See U.S. Pat. No. 3,227,554)

a. 1-(2,4,6-Trichlorophenyl)-3-[3-{α-(3-pentadecylphenoxy)butyramido}benzamido]-4-(1-phenyl-5-tetrazolylthio)-5-pyrazolone
b. 1-[4-(4-tert-butylphenoxy)phenyl]-3-phenyl-4-(1-phenyl-5-tetrazolylthio)-5-pyrazolone
c. 1-[4-(4-tert-butylphenoxy)phenyl]-3-[-4-tert-butylphenoxy)propionamido]-4-(4-phenyl-1,3,4-oxadiazolyl-2-thio)-5-pyrazolone
d. 1-[4-{α-(3-Pentadecyl-phenoxy)butyl}amido phenyl]-3-ethoxy-4-(1-phenyl-5-tetrazolylthio)-5-pyrazolone)
e. 1-{4-[α-(2,4-di-tert-amylphenoxy)butyramido]-phenyl}-3-(1-pyrrolidine)-4-(1-phenyl-5-tetrazolylthio)-5-pyrazolone Coupler Group No. 7 - Magenta dye-forming color coupler (See U.S. Pat. No. 2,983,608)

a. 1-(2,4,6-Trichlorophenyl)-3-{4-[α-(2,4-di-tert-amylphenoxy)butyramido]anilino}-4-(2-ethoxyphenyl-)azo-5-pyrazolone
b. 1-(2,4,6-Trichlorophenyl)-3-[3-(2,4-diamylphenoxyacetamido)benzamido]-4-(p-methoxyphenylazo)-5-pyrazolone.

The invention has been described in detail with particular reference to preferred embodiments thereof, but, it will be understood that variations and modifications can be effected within the spirit and scope of the invention.

What is claimed is:

1. In a multilayer, multicolor photographic element comprising a support having coated thereon dye-forming, hydrophilic colloid-containing silver halide emulsion layers which are spectrally sensitized to different regions of the visible spectrum, said element being comprised of at least one blue-sensitive emulsion layer, a yellow filter layer underlying said blue-sensitive layer, a plurality of green-sensitive silver halide emulsion layers and a plurality of red-sensitive silver halide emulsion layers; one of said green-sensitive emulsion layers being a faster green-sensitive layer and exhibiting a faster photographic speed than that of at least one other of said green-sensitive emulsion layers and one of said red-sensitive emulsion layers being a faster red-sensitive layer and exhibiting a faster photographic speed than that of at least one other of said red-sensitive emulsion layers;

the improvement comprising said faster green-sensitive emulsion layer and said faster red-sensitive emulsion layer being located in adjacent relationship to form a faster emulsion unit, said one other, slower, green-sensitive emulsion layer and said one other, slower, red-sensitive emulsion layer being located in adjacent relationship to form a slower emulsion unit, said slower emulsion unit being located between said faster emulsion unit and said support, in each of said faster emulsion unit and said slower emulsion unit, said red-sensitive layer being positioned closer than said green-sensitive layer to said support, and said blue-sensitive layer or layers being farther from the support than said faster emulsion unit.

2. An improved photographic element as defined in claim 1 wherein said slower emulsion unit comprises two sub-units: (a) a first sub-unit comprising a green-sensitive silver halide layer of speed intermediate between that of said faster green-sensitive silver halide layer and that of a still slower green-sensitive silver halide layer located in (b) a second sub-unit, said second sub-unit being closer to said support than said first sub-unit; said first sub-unit containing a red-sensitive silver halide layer of speed intermediate between that of said faster red-sensitive silver halide layer and that of a still slower red-sensitive silver halide layer, said still slower red-sensitive silver halide layer being located in said second sub-unit.

3. An improved photographic element as in claim 2, wherein the difference in photographic speed between each of said green-sensitive emulsion layers is from about 0.2 to about 1 log E, and the difference in photographic speed between each of said red-sensitive emulsion layers is from about 0.2 to about 1 log E.

4. An improved photographic element as in claim 3, wherein a development inhibitor releasing coupler is in association with said slower emulsion unit.

5. An improved photographic element as in claim 1, wherein a development inhibitor releasing coupler is in association with said slower green-sensitive layer.

6. In a multilayer, multicolor photographic element containing incorporated dye-forming coupler compounds and comprising a support, at least one blue-sensitive silver halide emulsion layer, a yellow filter layer underlying said blue-sensitive emulsion layer at least one faster green-sensitive silver halide emulsion layer, at least one slower green-sensitive silver halide emulsion layer, at least one faster red-sensitive silver halide emulsion layer and at least one slower red-sensitive silver halide emulsion layer; the improvement comprising (1) said faster green-sensitive emulsion layer and said faster red-sensitive emulsion layer being positioned in adjacent relationship to form a faster emulsion unit;

(2) said slower green-sensitive emulsion layer and said slower red-sensitive emulsion layer being positioned in adjacent relationship to form a slower emulsion unit;

(3) said slower emulsion unit being positioned closer to said support than said faster emulsion unit;

(4) in each of said faster emulsion unit and said slower emulsion unit, said red-sensitive emulsion layer is positioned nearer to said support than said green-sensitive emulsion layer;

(5) said blue-sensitive emulsion layer or layers and said yellow filter layer being positioned farther from said support than said faster emulsion unit; and (6) each of said emulsion layers being capable of forming a dye upon color development, the hue of said dye being complimentary to the light to which said layer is sensitive.

7. An improved photographic element as defined in claim 6 wherein said slower emulsion unit comprises two sub-units: (a) a first sub-unit comprising a green-sensitive silver halide layer of speed intermediate between that of said faster green-sensitive silver halide layer and that of a still slower green-sensitive silver halide layer located in (b) a second sub-unit, said second sub-unit being closer to said support than said first sub-unit; said first sub-unit containing a red-sensitive silver halide layer of speed intermediate between that of said faster red-sensitive silver halide layer and that of a still slower red-sensitive silver halide layer, said still slower red-sensitive silver halide layer being located in said second sub-unit.

8. An improved photographic element as in claim 7, wherein the difference in photographic speed between each of said green-sensitive emulsion layers is from about 0.2 to about 1 log E, and the difference in photographic speed between each of said red-sensitive emulsion layers is from about 0.2 to about 1 log E.

9. An improved photographic element as in claim 8, wherein a development inhibitor releasing coupler is in association with said slower emulsion unit.

10. An improved photographic element as in claim 6, wherein a development inhibitor releasing coupler is in association with said slower green-sensitive layer.

11. An improved photographic element as in claim 10, wherein a development inhibitor releasing coupler is in association with said slower green-sensitive layer.

12. An improved photographic element as in claim 10, wherein a development inhibitor releasing coupler is in association with said slower emulsion unit.

13. An improved photographic element as in claim 10, wherein said difference in photographic speed is about 0.5 log E.

14. In a multilayer, multicolor photographic element containing incorporated dye-forming coupler compounds and comprising a support, at least one blue-sensitive silver halide emulsion layer, a yellow filter layer underlying said blue-sensitive emulsion layer, at least one faster green-sensitive silver halide emulsion layer, at least one slower green-sensitive silver halide emulsion layer, at least one faster red-sensitive silver halide emulsion layer and at least one slower red-sensitive silver halide emulsion layer; the improvement comprising (1) said faster green-sensitive emulsion layer and said faster red-sensitive emulsion layer being positioned in adjacent relationship to form a faster emulsion unit;

(2) said slower green-sensitive emulsion layer and said slower red-sensitive emulsion layer being positioned in adjacent relationship to form a slower emulsion unit;

(3) said slower emulsion unit being positioned closer to said support than said faster emulsion unit;

(4) in each of said faster emulsion unit and said slower emulsion unit, said red-sensitive emulsion layer being positioned nearer to said support than said green-sensitive emulsion layer;

(5) said faster green-sensitive emulsion layer and said slower green-sensitive emulsion layer differing in photographic speed by about 0.2 to 1 log E;

(6) said faster red-sensitive emulsion layer and said slower red-sensitive emulsion layer differing in photographic speed by about 0.2 to 1 log E;

(7) said blue-sensitive emulsion layer or layers and said yellow filter layer being positioned farther from said support than said faster emulsion unit; and (8) each of said emulsion layers being capable of forming a dye upon color development, the hue of said dye being complimentary to the light to which said layer is sensitive.

15. An improved photographic element as in claim 14, wherein a development inhibitor releasing coupler is in association with said slower green-sensitive layer.

16. An improved photographic element as in claim 14, wherein a development inhibitor releasing coupler is in association with said slower emulsion unit.

17. An improved photographic element as in claim 14, wherein said difference in photographic speed is about 0.5 log E.

18. A photographic silver halide multilayer color material adapted for exposure to light having a support bearing at least one blue-sensitive silver halide emulsion layer, at least two green-sensitive silver halide emulsion layers differing in photographic speed by about 0.2 to 1 log E and at least two red-sensitive silver halide emulsion layers differing in photographic speed by about 0.2 to 1 log E, wherein the positions of the layers are such that, in use, after penetrating the blue-sensitive layer or layers, exposing light strikes the faster green- and red-sensitive emulsion layers before passing to the slower green- and red-sensitive layers.

19. An improved photographic element as in claim 18, wherein said difference in photographic speed is about 0.5 log E.

20. A photographic silver halide multilayer color material adapted for exposure to light having a support bearing at least one blue-sensitive silver halide emulsion layer, at least two green-sensitive silver halide emulsion layers having different speeds and at least two red-sensitive silver halide emulsion layers having different speeds, wherein the positions of the layers are such that, in use, after penetrating the blue-sensitive layer or layers, the exposing light strikes the faster green- and red-sensitive emulsion layers before passing to the slower green- and red-sensitive layers.

21. In a multilayer, multicolor photographic element comprising a support having coated thereon hydrophilic colloid-containing silver halide emulsion layers which are spectrally sensitized to different regions of the visible spectrum, said element being comprised of at least one blue-sensitive emulsion layer, a yellow filter layer underlying said blue-sensitive layer, a plurality of green-sensitive silver halide emulsion layers and a plurality of red-sensitive silver halide emulsion layers; one of said green-sensitive emulsion layers being a faster green-sensitive layer and exhibiting a faster photographic speed than that of at least one other of said green-sensitive emulsion layers and one of said red-sensitive emulsion layers being a faster red-sensitive layer and exhibiting a faster photographic speed than that of at least one other of said red-sensitive emulsion layers;

the improvement comprising said faster green-sensitive emulsion layer and said faster red-sensitive emulsion layer being located in adjacent relationship to form a faster emulsion unit, said one other, slower, green-sensitive emulsion layer and said one other, slower, red-sensitive emulsion layer being located in adjacent relationship to form a slower emulsion unit, said faster green-sensitive emulsion layer and said slower green-sensitive emulsion layer differing in photographic speed by about 0.2 to 1 log E, said faster red-sensitive emulsion layer and said slower red-sensitive emulsion layer differing in photographic speed by about 0.2 to 1 log E, said slower emulsion unit being located between said faster emulsion unit and said support, in each of said faster emulsion unit and said slower emulsion unit, said red-sensitive layer being positioned closer than said green-sensitive layer to said support, and said blue-sensitive layer or layers being farther from the support than said faster emulsion unit.

* * * * *